US005226408A

United States Patent [19]

Drysdale

[11] Patent Number: 5,226,408

[45] Date of Patent: Jul. 13, 1993

[54] METHOD AND APPARATUS FOR HEATING A SPA

[75] Inventor: Keith Drysdale, Edmonton, Canada

[73] Assignee: K. D. Heating Systems, Inc., Canada

[21] Appl. No.: 868,004

[22] Filed: Apr. 14, 1992

[30] Foreign Application Priority Data

Dec. 9, 1991 [CA] Canada ..... 2057527

[51] Int. Cl.[5] ..... F24C 9/00

[52] U.S. Cl. ..... 126/247; 126/344; 126/374; 4/493; 4/492; 4/541.3; 4/509

[58] Field of Search ..... 126/247, 344, 374; 4/493, 492, 509, 524, 525, 541.3, 544; 122/26

[56] References Cited

U.S. PATENT DOCUMENTS 4,529,033 7/1985 Blum ..... 4/493 X
4,853,987 8/1989 Jaworski ..... 4/509 X
4,855,569 8/1989 Wiedemann ..... 4/493 X

FOREIGN PATENT DOCUMENTS 2843399 10/1980 Fed. Rep. of Germany .
2035541 6/1980 United Kingdom ..... 126/247

OTHER PUBLICATIONS

Brochure from Heatflo Division, Fiberglass Specialities Inc. (no date).

*Primary Examiner*—Larry Jones
*Attorney, Agent, or Firm*—Davis, Bujold & Streck

[57] ABSTRACT

A method and apparatus for heating water in a spa which has a plurality of venturi jets, a hosing which includes a plurality of venturi jets and a high speed pump which circulates water through the housing and the venturi jets in the spa and a water thermostat. The thermostat is positioned in the water of the spa and connected to the high speed pump such that the high speed pump is activated to propel water through the venturi jets at high speed and thus heat it whenever the water temperature falls below a preset level.

2 Claims, 2 Drawing Sheets

METHOD AND APPARATUS FOR HEATING A SPA

The present invention relates to a method and apparatus for heating a Spa.

BACKGROUND OF THE INVENTION

A spa is a large whirlpool bath capable of seating between two and eight persons in which water is circulated by means of venturi jets. A heater is standard equipment in all spa installations. The heater is used to heat the water. A form a water thermostat known as an "aquastat" is provided which intermittently activates the heater when the water temperature drops below a preset level. A pump is provided which is set on a timer and circulates water through the venturi jets when persons are using the spa.

SUMMARY OF THE INVENTION

What is required is a method and apparatus of heating a spa which involves the elimination of the heater.

According to one aspect of the present invention there is provided a method of heating water in a spa which has a plurality of venturi jets, a high speed pump which circulates water through the venturi jets, and a water thermostat. The method is comprised of a single step. Connect the water thermostat positioned in the water of the spa to the high speed pump, such that the high speed pump is activated to propel water through the venturi jets at high speed whenever the water temperature falls below a preset level.

The present invention began with a discovery. In responding to a series of service calls from spa owners complaining of malfunctioning aquastats a pattern emerged. It was discovered that the aquastats were functioning normally, and yet each spa owner had experienced a dramatic increase in water temperature. The common link was that the pumps for the spas were operating at high speed at the time of the service call. Subsequent experimentation determined that heater units for spas are redundant as water in a spa can be heated merely by leaving the pump on at high speed. The venturi effect of forcing water through a small orifice at high pressure results in an increase in the temperature of the water. By connecting the aquastat to the high speed pump, this discovery can be adapted for a useful application of heating water in a spa in a controlled manner.

Although beneficial results may be obtained through the use of the invention as described, the frequency of activation of the high speed pump can be reduced with minor modifications. Even more beneficial results may be obtained by having a low speed pump continuously circulating water at low speed through the venturi jets. The circulation of water at low speed, while it will not heat the water in the spa, assists in maintaining the temperature of the water so the high speed pump need not be activated as frequently. Either two separate pumps or a dual speed pump with high speed and low speed settings can be used.

Although beneficial results may be obtained through the use of the invention as described, when the spa is first filled it takes a number of hours for cold water to be heated by means of the high speed pump. Even more beneficial result may, therefore, be obtained by having an auxiliary unit interposed between the high speed pump and the venturi jets of the spa. The auxiliary unit consists of a housing having an inlet, an outlet and a plurality of venturi jets positioned between the inlet and the outlet. Water flowing through the housing must pass through the venturi jets. By increasing the number of venturi jets, the auxiliary unit serves to enhance the ability of the high speed pump to heat the water in the spa.

According to another aspect of the invention there is provided an apparatus for heating water in a spa which is comprised of a housing having an inlet and an outlet. A plurality of venturi jets are positioned in the housing between the inlet and the outlet such that water flowing through the housing must pass through the venturi jets.

BRIEF DESCRIPTION OF THE DRAWINGS

These and other features of the invention will become more apparent from the following description in which reference is made to the appended drawings, wherein.

DETAILED DESCRIPTION OF THE PREFERRED EMBODIMENT

Figure 1:
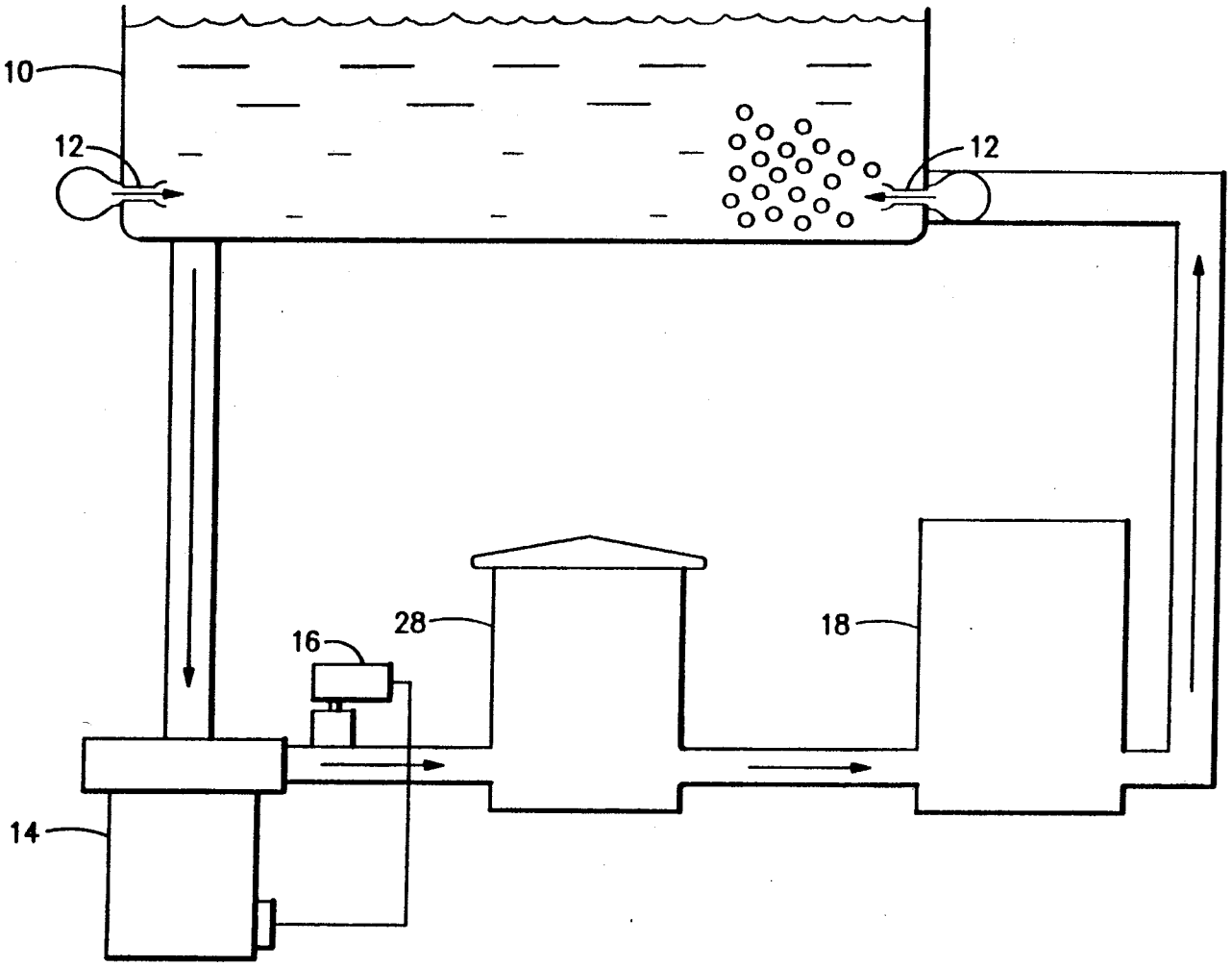
FIG. 1 is a diagrammatic illustration of a spa connected in accordance with the teachings of the present invention.
Figure 2:
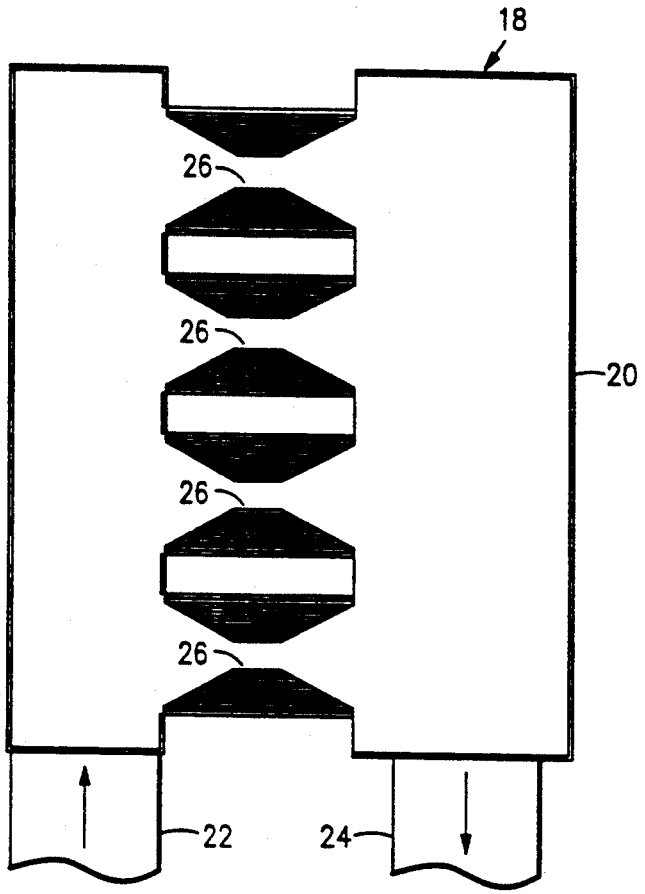
FIG. 2 is a section view of a apparatus constructed in accordance with the teachings of the present invention.

The method of heating water in a spa will now be described with reference to FIG. 1. Referring to FIG. 1, the components used in accordance with the preferred method of heating water in a spa are spa 10, a plurality of venturi jets 12 in spa 10, a dual speed pump 14 with a high speed and a low speed setting which circulates water through venturi jets 12, and a water thermostat 16. It is to be noted that no heater is provided in this configuration. Water thermostat 16 is connected to dual speed pump 14. In addition, an auxiliary unit 18 is interposed between dual speed pump 14 and venturi jets 12 of spa 10. Referring to FIG. 2, auxiliary unit 18 consists of a housing 20 having an inlet 22 and an outlet 24. A plurality of venturi jets 26 are positioned in housing 20 between inlet 22 and outlet 24 such that water flowing through housing 20 must pass through venturi jets 26. A filter 28 is also provided.

The essence of the method is the coupling of water thermostat 16 to a high speed pump, such as dual speed pump 14. Dual speed pump 14 is switched to a high speed setting to propel water through venturi jets 12 at high speed whenever the temperature of water in spa 10 falls below a preset level. It is the venturi effect of forcing water through a small orifice at high pressure, such as venturi jets 12, which results in an increase in the temperature of the water. At all other times dual speed pump 14 operates at low speed continuously circulating water at low speed through venturi jets 12. The circulation of water at low speed, while it will not heat the water in spa 10, assists in maintaining the temperature of the water so the high speed pump setting need not be activated as frequently. Spa 10 can be effectively heated without the use of auxiliary unit 18. The use of auxiliary unit 18 enhances the speed at which the water may be heated. Water which flows through housing 20 of auxiliary unit 18 must pass through venturi jets 26. By increasing the number of venturi jets to which the water of spa 10 is exposed, auxiliary unit 18 serves to enhance the ability of dual speed pump 14 operating at high speed to heat the water in spa 10.

Figure 3:
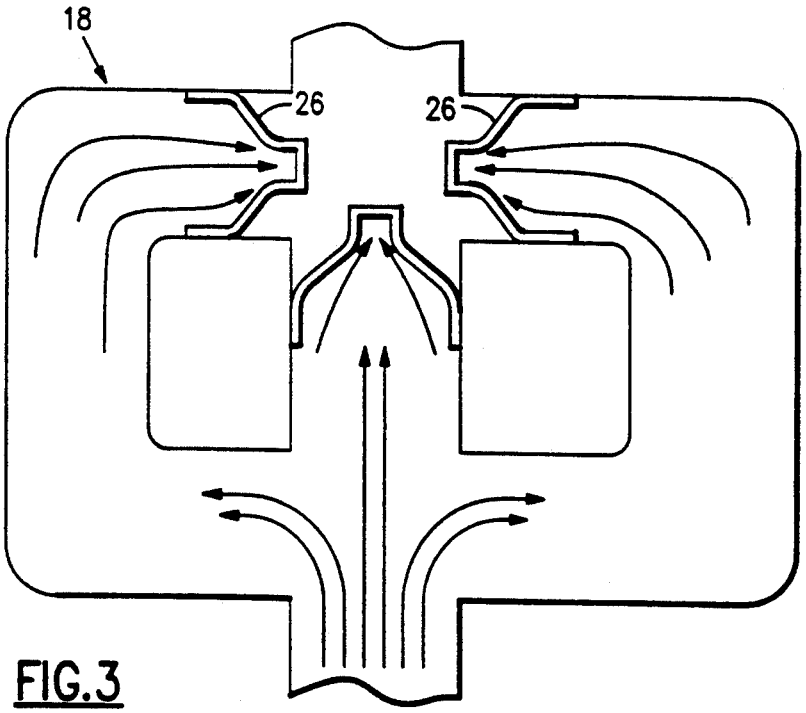
FIG. 3 is a section view of an alternative apparatus constructed in accordance with the teachings of the present invention.

FIG. 3 illustrates a modified version of auxiliary unit 18 which has been adapted for use with a fill and drain style of tub in which water is circulated. The problem with fill and drain tubs is that they have a rapid heat loss. The use of the modified version of auxiliary unit 18 compensates for this heat loss, thereby maintaining the temperature of the water. It should be noted that venturi jets 26 of the modified version of auxiliary unit 18 create a converging stream of water. The interaction of these water steams enhances the heat creation abilities of the apparatus.

It will be apparent to one skilled in the art that modifications can be made to the illustrated embodiment without departing from the spirit and scope of the invention. In particular, it will be apparent to one skilled in the art that a low speed pump used in combination with a high speed pump can replace dual speed pump 14 illustrated. It will also be apparent to one skilled in the art that the system can be made to operate with a single high speed pump, as the function of the low speed setting is merely to assist in maintaining spa 10 at a relatively stable temperature.

The embodiments of the invention in which an exclusive property or privilege is claimed are defined as follows:

1. In combination:

a spa which has a plurality of venturi jets, a high speed pump which circulates water through the venturi jets, and a water thermostat, the water thermostat being coupled with high speed pump such that the high speed pump is activated whenever the water temperature falls below a preset level;

a housing having an inlet and an outlet, the inlet communicating with the high speed pump and the outlet communicating with the venturi jets; and a plurality of venturi jets positioned in the housing between the inlet and the outlet such that water flowing through the hosing must pass through the venturi jets, whereby the water is heated.

2. A method of heating water in a spa which has a plurality of venturi jets, a high speed pump which circulates water through the venturi jets, and a water thermostat, comprising the steps of:

connecting an auxiliary unit between the high speed pump and the plurality of venturi jets of the spa, the auxiliary unit being comprises of a housing having an inlet, an outlet and a plurality of venturi jets positioned between the inlet and the outlet such that water flowing through the hosing must pass through the venturi jets; and connecting the water thermostat positioned in the water of the spa to the high speed pump, such that the high speed pump is activated to propel water through the venturi jets at high speed whenever the water temperature falls below a preset level.

* * * * *